United States Patent [19]

Pearce

[11] 4,014,157

[45] Mar. 29, 1977

[54] TRASH BAGGER

[76] Inventor: Richard Elmer Pearce, 3410 N. 66th, Lincoln, Nebr. 68507

[22] Filed: Apr. 30, 1976

[21] Appl. No.: 682,111

[52] U.S. Cl. ..... 53/35; 53/390; 141/390

[51] Int. Cl.[2] ..... B65B 1/04; B65B 67/12

[58] Field of Search ..... 53/35, 390, 124 B; 141/390, 391

[56] References Cited

UNITED STATES PATENTS

| | | | |
|---|---|---|---|
| 442,371 | 12/1890 | Gauntt | 141/390 X |
| 576,782 | 2/1897 | Goodrich | 141/390 |
| 1,503,183 | 7/1924 | Bailey | 53/124 B |
| 3,104,609 | 9/1963 | Crawford | 53/390 X |
| 3,254,467 | 6/1966 | Garrow et al. | 53/124 B X |

*Primary Examiner*—Travis S. McGehee
*Attorney, Agent, or Firm*—Vincent L. Carney

[57] ABSTRACT

To support the trash bag for filling, a conical frustum trash bag support having an open circular top and bottom is placed on the ground in inverted position with its top, which is the smaller of the top and bottom, down and the trash bag is pulled over its larger side and draped downwardly, after which, conical frustum and trash bag are reversed so that the trash bag is open end up and the conical frustum is right side up, and a ring is dropped over the top so that it rests on the bag at a location part way down from the top of the frustum to hold the bag in place with the upper end of the bag draped over the ring. The conical frustum is then filled with trash. To remove the conical frustum from the bag, the ring is pulled upwardly to straighten the bag and the conical frustum is pulled up, with the trash causing the bag to remain on the ground as the ring and conical frustum are removed, thus leaving the filled bag ready for disposal.

7 Claims, 3 Drawing Figures

FIG. 1
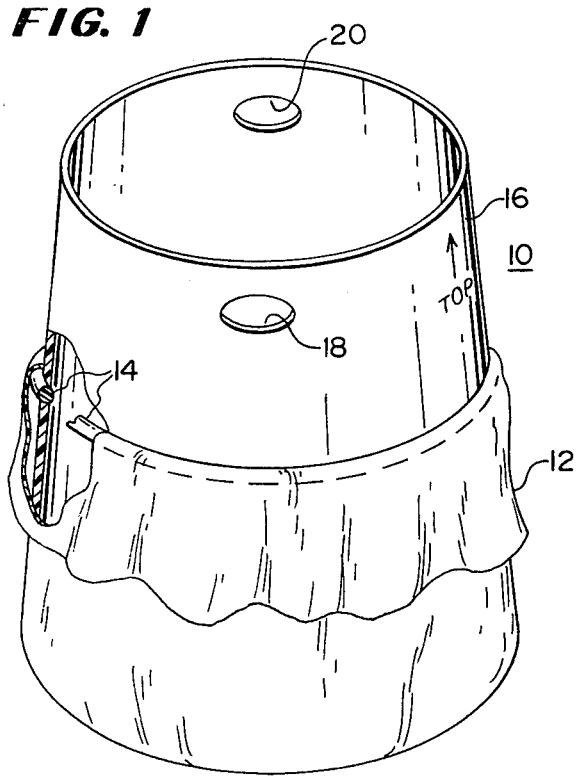
FIG. 2
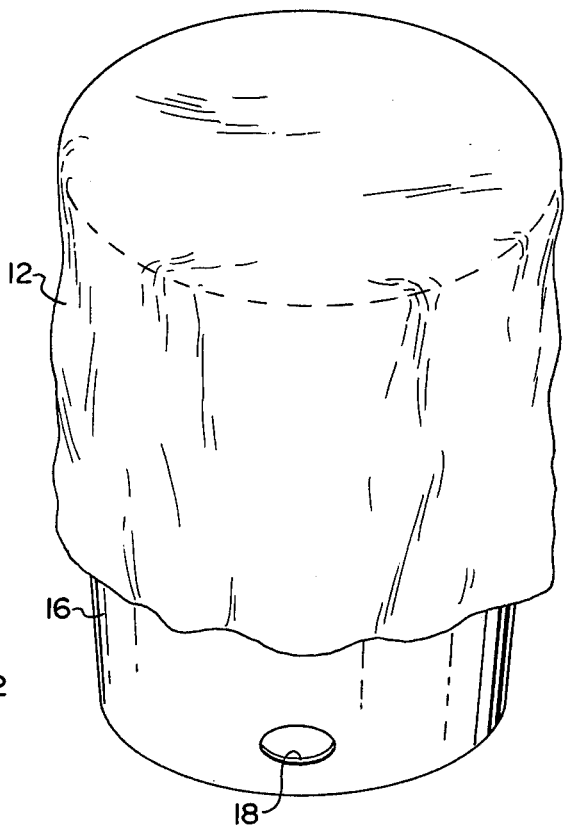
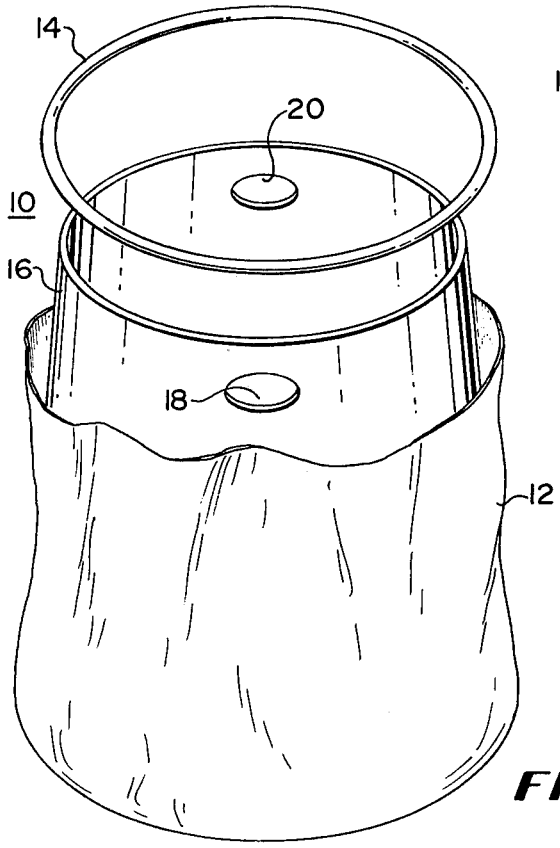
FIG. 3

TRASH BAGGER

This invention relates to packaging systems and more particularly to a method for holding bags open so that they may be filled.

In one class of systems for packaging, a hollow bag holder is inserted within a bag that is to be filled and the bag is held open while the ingredients of the bag are inserted through the hollow bag holder. After the bag is filled, the hollow bag holder is removed.

In a prior art type of packaging system of this class, the hollow bag holder is tubular and in some such tubular bag holders, a small cylinder is inserted within the bag and then opened to a larger cylinder so as to hold the bag tightly while the ingredients are inserted.

The prior art type of packaging system, has the disadvantages of being difficult to use or requiring relatively expensive bag holders.

Accordingly, it is an object of the invention to provide a novel packaging system.

It is a further object of the invention to provide a packaging system which is relatively easy to use, particularly for packaging waste products such as leaves or the like.

It is a still further object of the invention to provide a bag holder which is economical to construct and easy to use.

It is a still further object of the invention to provide a packaging system in which the bag holder is comprised of units which are close in structure to mass produced units already on the market so as to enable inexpensive fabrication.

In accordance with the above and further objects of the invention, a bag holder comprises a hollow support member shaped as a right, regular, conical frustum and a ring, with the support member having handles on its smaller-diameter end, which is the top, the bottom being of a larger diameter cross section.

To use the bag holder in packaging materials, the support member is inverted and the bag to be filled is pulled downward over the bottom. The positions of the bag and the support member are then reversed so the open end of the bag and the smaller diameter end of the support member face upwardly. In this position, a ring which has a diameter equal to the diameter of one right section through the support member between the top and bottom is dropped over the support member and bag and the upper end of the bag is folded over so that the ring holds the bag in place.

With the support member in its upright position and the bag held in place with the ring, the ingredients to be packaged, which may be waste products such as leaves, are inserted into the support member and contact the bag at its lower portion. When the desired number of ingredients are in the bag and support member, the support member is removed by lifting the ring upwardly and then pulling the support member upwardly by one or both of the handles. The materials that are within the support member and bag hold the bag down and the ring and conical frustum are removed so that the bag remains filled with the ingredients after the support member and ring have been removed.

From the above description, it can be understood that the packaging system of this invention is easy to use and the bag holder used in that system is simple and inexpensive. It is particularly inexpensive since its parts may be made from products already on the market such as a hula hoop for the ring and a plastic trash can with the bottom removed as the frustum conical support member.

The above noted and further features of the invention will be better understood from the following detailed description when considered in connection with the accompanying drawings in which:

FIG. 1 is a perspective view, partly broken away, of a bag holder, holding a bag open for filling.

FIG. 2 is a perspective view of a bag holder with a bag drawn over it in one position.

FIG. 3 is an exploded perspective view of a bag holder and bag in another stage of the mounting of the bag to the bag holder in accordance with the invention.

In FIG. 1, there is shown a trash bagger 10 shown with a trash bag 12 mounted to it in position for loading. The trash bagger 10 includes a plastic toroid or ring 14 and a support member 16 shaped as a hollow, truncated, right, regular cone having, in the preferred embodiment, two handle portions 18 and 20, which are advantageously hand-sized apertures cut in the truncated cone 16 near its top end at diametrically opposite locations. The smaller diameter end is the top of the support member 16 and the larger diameter is its bottom.

The ring 14 is of such a diameter as to fit against the side of the support member 16 at a location part way between the top and the bottom of the support member. The support member 16 is of sufficient size so that a trash bag, such as the trash bag 12, can be pulled around its largest-diameter end and extend at least part way up its side height. Preferably, the trash bag 12 is sufficiently large to permit it to extend from one end to a location beyond the other end of the support member 16.

In the preferred embodiment, both the ring 14 and the support member 16 are of plastic. A typical size support member 16 is 36 inches in height, 20 inches in diameter at its top and 24 inches in diameter at its bottom, although many different sizes may be used provided they are appropriately sized with respect to a ring 14 and bag 12.

To use the trash bagger 10, the support member 16 is turned upside down so that its smaller end rests upon the ground and a trash bag 12 pulled over its larger bottom end so that the combination rests as shown in FIG. 2. The bag and support member 16 are then turned right side up, the end of the bag 12 is draped around the top edge of the support member 16 to hold it in place and the ring 14 is dropped over the support member 16 and trash bag 12 as illustrated in the exploded view of FIG. 3. The loose portion of the bag 12 is then draped over the ring so that it is held as shown in FIG. 1.

With the trash bagger 10 in the position shown in FIG. 1, it may be filled. After it is filled, the edge of the bag is pulled over the upper edge of the support member 16 and the ring 14 is moved upwardly. The support member 16 is then pulled by the handles 18 and 20. The weight of the trash, which may consist of leaves, pulls the trash bag 12 free from the support member 16 so that the support member 16 is removed and the bag is filled with trash, grass, leaves or the like.

While a right conical frustum is used in the preferred embodiment in cooperation with a circular ring, other configuration may be used. A truncated pyramid, for example, is suitable, to hold the bag open. The main features of the unit for holding the bag open is that it has an open top and bottom and slanted sides so that the ingredients may be applied through the open top and contact the bag at the bottom while permitting the unit to be easily removed with the trash remaining in the bag.

The ring also may be of several different shapes, its main requirement being that it must fit over the apparatus for holding the bag open and therefore must contact it in multiple points along its tapered sides and these points must be spaced more than 180° around the longitudinal axis of the apparatus for holding the bag.

From the above description, it can be understood that the trash bagger 10 of this invention has the advantages of being simple in construction, inexpensive and permitting the easy filling of trash bags.

One reason why the bag holder of this invention is especially economical is that it is similar in construction to items that are now being mass produced. There are many rings on the market, one being commonly referred to as a hula hoop. Similarly, the support member can be formed from common conical trash cans which are now made of plastic and sold although the bottom must be removed or not initially formed with these containers.

Although a preferred embodiment of the invention has been described with some particularity, many modifications and variations of the preferred embodiment are possible within the light of the above teachings without deviating from the invention. Accordingly, it is to be understood that, within the scope of the appended claims, the invention may be practiced other than as specifically described.

What is claimed is:

1. A method of filling bags comprising steps of:

pulling the bag to be filled over a hollow bag holder having open bottom and top and at least one tapered side between the open bottom and top with the bottom of the bag covering the open bottom and the open end of the bag circumscribing said side, the top being smaller than the bottom;

placing over the bag a retainer which contacts the bag and presses it against the bag holder at least at three points along the bag which are spaced sufficiently far apart so as to subtend at least 180° of an angle having its center at a point along the longitudinal axis of the bag holder;

folding the end of the bag over the retainer;

applying the materials to be packaged through the open top of the bag holder and permitting them to fall against the bottom of the bag;

pulling the retainer upwardly to remove it from the bag when the desired amount of material is already in the bag; and pulling the bag holder upwardly to remove it from the bag.

2. A method according to claim 1 in which the step of pulling the bag over the hollow bag holder includes the step of inverting the hollow bag holder so that its bottom is upwardly and pulling the bag over the bag holder downwardly and then turning the bag and bag holder right-side up.

3. A method according to claim 1 in which the step of pulling the bag over the bag holder comprises the steps of pulling the bag over a right conical frustum, having a smaller open top than its open bottom.

4. A method according to claim 2 in which the step of pulling the bag over the bag holder comprises the steps of pulling the bag over a right conical frustum, having a smaller open top than its open bottom.

5. A method according to claim 1 in which the step of placing over the bag includes the step of placing a retainer which is a solid circular ring having a diameter the same as the diameter of a right section through the bag holder between its top and bottom over the bag and holder.

6. A method according to claim 2 in which the step of placing over the bag includes the step of placing a retainer which is a solid circular ring having a diameter the same as the diameter of a right section through the bag holder between its top and bottom over the bag and holder.

7. A method according to claim 4 in which the step of placing over the bag includes the step of placing a retainer which is a solid circular ring having a diameter the same as the diameter of a right section through the bag holder between its top and bottom over the bag and holder.

* * * * *